US005925614A

United States Patent [19]

Brougham et al.

[11] Patent Number: 5,925,614

[45] Date of Patent: Jul. 20, 1999

[54] PROCESS FOR PRODUCING GRANULAR DETERGENT COMPONENTS OR COMPOSITIONS

[75] Inventors: Peter Rutherford Brougham, Crawcrook; George Burgess, Cramlington, both of United Kingdom

[73] Assignee: The Procter & Gamble Company, Cincinnati, Ohio

[21] Appl. No.: 08/945,434

[22] PCT Filed: Mar. 27, 1996

[86] PCT No.: PCT/US96/04224

§ 371 Date: Oct. 24, 1997

§ 102(e) Date: Oct. 24, 1997

[87] PCT Pub. No.: WO96/34079

PCT Pub. Date: Oct. 31, 1996

[30] Foreign Application Priority Data

Apr. 27, 1995 [EP] European Pat. Off. ..... 95302860

[51] Int. Cl.[6] ..... C11D 1/83; C11D 3/08; C11D 7/14

[52] U.S. Cl. ..... 510/444; 510/466; 510/507

[58] Field of Search ..... 510/444, 466, 510/507

[56] References Cited

U.S. PATENT DOCUMENTS 4,264,464 4/1981 Gangwisch et al. ..... 252/91

5,009,804 4/1991 Clayton et al. ..... 252/90

5,259,994 11/1993 Welch et al. ..... 252/542

FOREIGN PATENT DOCUMENTS 0521635 1/1993 European Pat. Off. .

WO9325378 12/1993 WIPO .

*Primary Examiner*—Yogendra N. Gupta

*Assistant Examiner*—Gregory R. Delcotto

*Attorney, Agent, or Firm*—Jacobus C. Rasser; Kim W. Zerby; Pankaj M. Khosla

[57] ABSTRACT

The invention relates to a process for the preparation of a granular detergent composition or component having a bulk density greater than 650 g/l which has greater ease and flexibility of processing. The process comprises the step of dispersing a liquid binder throughout a powder stream in a high speed mixer to form granular agglomerates, wherein the powder stream comprises a powder consisting essentially of crystalline zeolite A, P, X, or mixtures thereof, and crystalline zeolite HS. It is preferred that the ratio of zeolite A, P, X, or mixtures thereof, to crystalline zeolite HS is from 1:1 to 99:1, preferably from 3:1 to 20:1, and that the powder has an oil absorbing capacity of at least 40 ml/100 g, more preferably at least 45 ml/100 g, most preferably at least 50 ml/100 g.

12 Claims, No Drawings

PROCESS FOR PRODUCING GRANULAR DETERGENT COMPONENTS OR COMPOSITIONS

The present invention relates to a process for the continuous preparation of a granular detergent composition or component having a high bulk density and good flow properties. In such compositions and components it is known to use crystalline Zeolite A which is a water-insoluble, crystalline material well-known in the detergent art as a builder which is particularly suited to removing cations such as calcium and magnesium from hard water.

Crystalline Zeolite A is a very finely divided powder. It has been common practice to process the finely divided powder into the form of larger granules (typically 400 to 1000 micrometers) before incorporation into finished products, especially finished detergent compositions. Various granulation processes are known including spray drying and agglomeration. Conventional agglomeration processes in which Zeolite A is used as one of the components have long been known in the prior art:

GB2005715, published on Apr. 25, 1979 describes an agglomeration process based upon Zeolite A. The Zeolite A is agglomerated along with carbonate/bicarbonate to make nonionic surfactant agglomerates.

WO93/25378, published on Dec. 23, 1993, discloses a process for making granular detergents comprising Zeolite A. The Zeolite A is agglomerated with a high active, neutralised surfactant paste in a high speed mixer and a moderate speed mixer/agglomerator to make anionic surfactant agglomerates.

One of the factors which limits the surfactant activity of the prior art mentioned above is the capacity of Zeolite A to absorb liquid organic materials. It has been suggested that replacing Zeolite A by Zeolite P (specifically Zeolite MAP) could address this problem:

EP521635, published on Jan. 7, 1993, discloses granular detergents made using from 10% to 100% of Zeolite MAP. Zeolite MAP has a different chemical composition to Zeolite A. In Example 1 of this patent application it is reported that the oil absorbing capacity of Zeolite MAP is 41.6 ml/100 g, and that this is higher than measured samples of Zeolite A for which it is 26 to 35.5 ml/100 g. However modifying the chemical structure of conventional crystalline Zeolite A (i.e. modifying the stoichiometric ratios of Si, Al, Na, O, H) is not always desirable because other properties and characteristics of the Zeolite are necessarily affected.

The object of the invention is to provide a granulation process for making granular detergents which incorporates highly absorbent crystalline Zeolite into granular agglomerates, without losing any of the builder capabilities, especially calcium exchange capacity and calcium exchange rate.

According to the invention this object is achieved by using a crystalline Zeolite which consists essentially of Zeolite A, P, X, (or mixtures thereof) and Zeolite HS (Hydroxy Sodalite). This is in marked contrast to prior art zeolites in which zeolite HS has been regarded as an impurity, and its formation has been avoided. The zeolite of the present invention has modified physical characteristics (i.e. crystallinity, surface area characteristics, moisture level etc.) which in turn promotes greater ease and flexibility in processing during the manufacture of detergent powders. The basic chemical structure of the zeolite is unchanged, hence the excellent builder properties of zeolite may still be utilised.

It is a further object of the present invention to provide a granulation process for making granular detergents having improved processability, and amount of oversize particles (or "lumps") being formed in the process being reduced.

SUMMARY OF THE INVENTION

A process for the preparation of a granular detergent composition or component having a bulk density greater than 650 g/l, which comprises the step of dispersing a liquid binder throughout a powder stream in a high speed mixer to form granular agglomerates, wherein the powder stream comprises a powder consisting essentially of crystalline zeolite A, P, X, or mixtures thereof, and crystalline zeolite HS.

It is preferred that the ratio of zeolite A, P, X, or mixtures thereof, to crystalline zeolite HS is from 1:1 to 99:1, preferably from 3:1 to 20:1, and that the powder has an oil absorbing capacity of at least 40 ml/100 g, more preferably at least 45 ml/100 g, most preferably at least 50 ml/100 g.

In a preferred embodiment of the invention the granular agglomerates are formed by mixing in the high speed mixer for a residence time of from about 2 seconds to about 30 seconds, followed by the step of further mixing in a moderate speed mixer/agglomerator for a residence time through the moderate speed mixer of less than about 5 minutes, preferably less than about 2 minutes, in which, optionally, a finely divided powder may be added.

In different embodiments of the invention the liquid binder is a surfactant paste, an organic polymer or silicone oil. Surfactant paste may comprise anionic, nonionic, cationic, amphoteric, zwitterionic surfactants, and mixtures thereof; anionic and/or nonionic surfactants being most preferred.

DETAILED DESCRIPTION OF THE INVENTION

Granulation in the context of the present invention is defined as a process of making a granulated product which is an agglomerate of particles that itself behaves as a particle (according to S. A. Kuti, "Agglomeration—The Practical Alternative", published in Journal American Oil Chemists' Society, Volume 55, January 1978). The granular agglomerate is defined herein as the product of such a granulation process. Kuti goes on to state that "the agglomerate is usually formed by blending solids with liquids that serve as adhesive agents. But a lump-free liquid-solids blend is often a difficult task to produce."

In the present invention the "solids" referred to by Kuti will comprise crystalline zeolite having certain physical characteristics to be defined in more detail below. It has now been found that this choice of "solids" contributes greatly to fulfilling the task of producing a lump-free liquid-solids blend.

The essential component of the granular agglomerate of the present invention is crystalline Zeolite HS of the formula:

$$(Na2O).(Al2O3).x(SiO2).wH2O$$

wherein x is 2, and w is about 2.5 (From D. W. Breck, "Zeolite Molecular Sieves", John Wiley & Sons, New York, 1974, page 155). Zeolite HS is also known as Zeolite G, Sodalite Hydrate and Hydroxy Sodalite.

The ideal unit cell composition for sodalite hydrate is:

$$Na_6AlO_6Si_6O_{24}.\ 8H_2O \qquad \text{(Breck, page 269)}$$

If NaOH is intercalated during synthesis, the composition varies according to:

$Na_6AlO_6Si_6O_{24}.xNaOH(8-2x)H_2O$ (Breck, page 272)

since one NaOH replaces two water molecules. Sodium hydrate has been observed to adsorb water after dehydration.

Breck also says that "silica rich zeolite A appears to crystallise well in a period of 1 hour which is followed by rapid conversion in many instances to hydroxysodalite. This is to be expected from sodium rich compositions of this type. The formation of hydroxysodalite was also accelerated when various anions were added to the gel compositions."

For the purposes of the present invention it is necessary to control reaction conditions such that crystalline zeolite A (or P, X) is formed in the required ratio to zeolite HS. Preferred ways of doing this are to use sodium-rich gels in the zeolite formation and to carefully control the presence of various anions as well as the crystallisation temperature.

Elecron microscopy has shown crystals of zeolite HS "growing" from the surface of the zeolite A. Without wishing to be bound by theory it is suggested that this surface modification effect results in the desired higher oil adsorption values of the zeolite powder.

Crystalline zeolites (other than zeolite HS) are also essential features of the present invention. Certain crystalline zeolites are of great importance in most currently marketed heavy duty granular detergent compositions on account of their detergent builder capacities. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations zeolite A, zeolite P(B), zeolite MAP, zeolite X and zeolite Y. In an especially preferred embodiment, the crystalline aluminosilicate ion exchange material has the formula:

$$Na_{12}[(AlO_2)_{12}(SiO2)_{12}].xH_2O$$

wherein x is from about 20 to about 30, especially about 27. This material is known as zeolite A. Dehydrated zeolites (x=0–10), and "overdried" zeolites (x=10–20) may also be used herein. The "overdried" zeolites are particularly useful when a low moisture environment is required, for example to improve stability of detergent bleaches such as perborate and percarbonate. Preferably, the aluminosilicate has a particle size of about 0.1–10 micrometers in diameter. Preferred ion exchange materials have a particle size diameter of from about 0.2 micrometers to about 4 micrometers. The term "particle size diameter" herein represents the average particle size diameter by weight of a given ion exchange material as determined by conventional analytical techniques such as, for example, microscopic determination utilizing a scanning electron microscope. The crystalline zeolite A materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The zeolite A materials herein are still further characterized by their calcium ion exchange rate which is at least about 2 grains $Ca^{++}$/gallon/minute/gram/gallon (0.13 g $Ca^{++}$/liter/minute/gram/liter) of aluminosilicate (anhydrous basis), and generally lies within the range of from about 2 grains/gallon/minute/gram/gallon(0.13 g $Ca^{++}$/liter/minute/gram/liter) to about 6 grains/gallon/minute/gram/gallon (0.39 g $Ca^{++}$/liter/minute/gram/liter), based on calcium ion hardness. Optimum aluminosilicate for builder purposes exhibit a calcium ion exchange rate of at least about 4 grains/gallon/minute/gram/gallon (0.26 g $Ca^{++}$/liter/minute/gram/liter).

The granular agglomerates of the present invention also comprise other detergent ingredients.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383; and methyl ester sulphonates. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

Water-soluble nonionic surfactants are also useful as surfactants in the compositions of the invention. Indeed, preferred processes use anionic/nonionic blends. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 1 to 25 moles of ethylene oxide per mole of alcohol, especially 2 to 7 moles of ethylene oxide per mole of alcohol. Particularly preferred are the condensation products of alcohols having an alkyl group containing from about 9 to 15 carbon atoms; and condensation products of propylene glycol with ethylene oxide.

Other preferred nonionics are polyhydroxy fatty acid amides which may be prepared by reacting a fatty acid ester and an N-alkyl polyhydroxy amine. The preferred amine for use in the present invention is N—(R1)—CH2(CH2OH)4—CH2—OH and the preferred ester is a C12–C20 fatty acid methyl ester. Most preferred is the reaction product of N-methyl glucamine (which may be derived from glucose) with C12–C20 fatty acid methyl ester.

Methods of manufacturing polyhydroxy fatty acid amides have been described in WO 9206073, published on Apr. 16, 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols (page 15, lines 22–27). This directly yields nonionic surfactant systems which are suitable for use in the present invention, such as those comprising N-methyl glucamide and C12–C14 alcohols with an average of 3 ethoxylate groups per molecule.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, and is preferably free of the latter.

Polymers

Also useful are various organic polymers, some of which also may function as builders to improve detergency. The organic polymers may be included in an amount of at least 30% by weight. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000. Other suitable polymers are polyamine N-oxide polymers, copolymers of N-vinylpyrrolidone and N-vinylimidazole, polyvinylpyrrolidone polymers, polyvinyloxazolidones and polyvinylimidazoles or mixtures thereof.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Silicone Oils

Particulate suds suppressors may also be incorporated either directly in the agglomerates herein by way of the powder stream into the agglomerating unit, or in the finished composition by dry adding. The silicone oil may be included in an amount of at least 30% by weight. Preferably the suds suppressing activity of these particles is based on fatty acids or silicones.

In one embodiment of the present invention the silicone oil is adsorbed onto the specified Zeolite A.

Optionals

Other ingredients commonly used in detergent compositions can be included in the compositions of the present invention. These include flow aids, color speckles, bleaching agents and bleach activators, suds boosters or suds suppressors, antitarnish and anticorrosion agents, soil suspending agents, soil release agents, dyes, fillers, optical brighteners, germicides, pH adjusting agents, nonbuilder alkalinity sources, hydrotropes, enzymes, enzyme-stabilizing agents, chelating agents and perfumes.

These optional ingredients, especially optical brighteners, may be incorporated either directly in the agglomerates herein or may be components of separate particles suitable for dry adding to the agglomerates of the present invention.

Processing

Useful agglomeration processes are defined in EP-A-510746, published on Oct. 28, 1992, and in WO93/25378, published on Dec. 23, 1993. These applications describe the agglomeration of solids with a high active neutralised surfactant paste. However it will be appreciated that the high active neutralised paste could be replaced fully or in part by other surfactants, especially nonionic surfactants (as in EP643130, published on Mar. 15, 1995), or by organic polymers or silicone oils. Preferred embodiments of the process are described in more detail in the Examples below.

TEST METHOD

Oil absorption values can be determined by following British Standards, BS3483 : Part 7 :1982 (corresponding to ISO 787/5-1980). A 5 gram sample of zeolite having a free alkalinity of less than 0.5% should be used. Oil absorption value (OAV) is expressed as:

$$OAV = \frac{\text{Volume of oil (ml)}}{\text{Wt. of Zeolite sample (g)}}$$

EXAMPLES

All values are expressed in % by weight. Zeolite levels are expressed on a hydrated basis (including 15% by weight of bound water)

| | Ex. 1 | Ex. 2 | Ex. 3 | Comp. Ex. A |
|---|---|---|---|---|
| Zeolite A/HS* | 32 | 22 | 52 | — |
| Zeolite A # | — | — | — | 32 |
| C12–15 AS | 24 | 31 | — | 24 |
| C12–15 AE3S | 6 | 8 | — | 6 |
| Sodium Carbonate | 25 | 12 | 13 | 25 |
| Co-polymer | — | 12 | — | — |
| Nonionic Surfactant | — | — | 30 | — |
| Water | 5 | 5 | — | 5 |
| Misc. | 8 | 10 | 5 | 8 |

Zeolite A/HS* has an oil absorption capacity of 45.5 ml/100 g supplied by Industrial Zeolites (UK) Ltd. of Thurrock, Essex, England.

Zeolite A # has an oil absorption capacity of 36 ml/100 g supplied by Degussa under the Trade Name Wessalith®.

C12–15AS is sodium alkyl sulphate, the alkyl chains principally comprising C12 to C15.

C12–15AE3S is sodium alkyl ether sulphate, the alkyl chains principally comprising C12 to C15, and with an average of 3 ethoxy groups per molecule.

Co-polymer is a co-polymer of acrylic and maleic acid. Nonionic surfactant comprises 7 parts of ethoxylated alcohol, the alkyl chains principally comprising C12 to C15, and with an average of 3 ethoxy groups per molecule; and 3 parts of C12–14 polyhydroxy fatty acid amide.

Misc is mainly sulphate with some other minor impurities.

Granular agglomerates having the composition of Example 1 were prepared by the following process. The powdered raw materials (Zeolite A/HS and sodium carbonate) were added to the pan of an Eirich® mixer rotated at 64 rpm and mixed for 10 seconds. The mixer pan was then stopped and preheated surfactant paste (50° C.), 80% surfactant active in aqueous solution, was then added in slices into a hollow formed in the middle of the powder. Loose powder being scooped over the paste to completely cover it. The mixer was then started again with pan rotating at 64 rpm, and choppers set at 2500 rpm. The mixing was stopped when granular agglomerates started to form (at this point the current drawn by the Eirich rose from 2.8 to 3 amps.

The resulting granular agglomerates were free-flowing and had less than 25% by weight of oversized particles (oversized particles be considered as those having particle size of greater than 1600 micrometers).

Granular agglomerates having the composition of Examples 2 were prepared by the following process.

A paste comprising the surfactants was prepared by sulphating and neutralising appropriate alcohols. The resulting paste had a water content of 18%. The paste was pumped into a high shear mixer (Loedige CB®). Simultaneously Zeolite A/HS and sodium carbonate were fed into the high shear mixer and intimately mixed with the high viscosity paste therein. The resulting mixture was transferred directly to a low shear mixer (Loedige KM®) were agglomerates formed. After exiting from the low shear mixer the agglomerates were screened to remove oversize "lumps" and fines. Finally the agglomerates were cooled in a fluid bed and stored prior to dry mixing with other detergent powders in order to form a finished product. The residence time in the high shear mixer was approximately 8 seconds, and the residence time in the low shear mixer was approximately 35 seconds.

Granular agglomerates having the composition of Example 3 were prepared by the same process as Example 2, the anionic surfactant paste being replaced by the nonionic surfactant maintained as a viscous paste at 70° C.

Granular agglomerates having the composition of Comparative Example A were prepared by the same process as Example 1, using the same time of mixing the powders and paste as that used in Example 1. The resulting granular agglomerates had greater than 25% by weight of oversized particles (oversized particles be considered as those having particle size of greater than 1600 micrometers).

We claim:

1. A process for the preparation of a granular detergent composition or component having a bulk density greater than 650 g/l, which comprises the step of dispersing a liquid binder throughout a powder stream in a high speed mixer to form granular agglomerates, wherein the powder stream comprises a powder consisting essentially of crystalline zeolite P and crystalline zeolite HS and having an oil absorbing capacity of at least 40 ml/100 g.

2. A process according to claim 1, wherein the ratio of zeolite P to crystalline zeolite HS is from 1:1 to 99:1.

3. A process according to claim 1, wherein the granular agglomerates are formed by mixing in the high speed mixer for a residence time of from about 2 seconds to about 30 seconds, followed by the step of further mixing in a moderate speed mixer/agglomerator for a residence time through the moderate speed mixer of less than about 5 minutes, in which, optionally, a finely divided powder may be added.

4. Process according to claim 3 wherein the liquid binder is a paste which comprises at least 10% by weight of a neutralised anionic surfactant, the paste having a viscosity of at least 10000 mPas.

5. Process according to claim 4, wherein the liquid binder is a surfactant paste which comprises at least 70% by weight of surfactant, the surfactant being selected from the group consisting of anionic, nonionic, cationic, amphoteric, and zwitterionic surfactants, and mixtures thereof.

6. Process according to claim 4 wherein the granular detergent composition or component comprises:

a) from 20% to 80% by weight of a powder consisting essentially of crystalline zeolite P and crystalline zeolite HS; and b) at least 20% by weight of surfactant.

7. Process according to claim 4 wherein the granular detergent composition or component comprises:

a) from 20% to 70% by weight of a powder consisting essentially of crystalline zeolite P and crystalline zeolite HS; and b) at least 30% by weight of anionic surfactant.

8. Process according to claim 4 wherein the granular detergent composition or component comprises:

a) from 20% to 80% by weight of a powder consisting essentially of crystalline zeolite P and crystalline zeolite HS; and b) at least 20% by weight of nonionic surfactant.

9. Process according to claim 2 wherein the granular detergent composition or component comprises:

a) from 20% to 70% by weight of a powder consisting essentially of crystalline zeolite P and crystalline zeolite HS; and b) at least 30% by weight of an organic polymer.

10. Process according to claim 2 wherein the granular detergent composition or component comprises:

a) from 20% to 70% by weight of a powder consisting essentially of crystalline zeolite P and crystalline zeolite HS; and b) at least 30% by weight of a silicone oil.

11. A process according to claim 2 wherein the ratio of zeolite P to crystalline zeolite HS is from 3:1 to 20:1.

12. A process according to claim 3, wherein the granular agglomerates are formed by mixing in the high speed mixer for a residence time of from about 2 seconds to about 30 seconds, followed by the step of further mixing in a moderate speed mixer/agglomerator for a residence time through the moderate speed mixer of less than about 2 minutes, in which, optionally, a finely divided powder may be added.

* * * * *